US009057168B1

(12) United States Patent
Dugan, Jr.

(10) Patent No.: US 9,057,168 B1
(45) Date of Patent: Jun. 16, 2015

(54) GABION EROSION AND SEDIMENT CONTROL DEVICE

(71) Applicant: Louis I. Dugan, Jr., Hammond, LA (US)

(72) Inventor: Louis I. Dugan, Jr., Hammond, LA (US)

( * ) Notice: Subject to any disclaimer, the term of this patent is extended or adjusted under 35 U.S.C. 154(b) by 67 days.

(21) Appl. No.: 13/898,085

(22) Filed: May 20, 2013

Related U.S. Application Data

(60) Provisional application No. 61/689,362, filed on Jun. 5, 2012.

(51) Int. Cl.
*E02D 29/02* (2006.01)
*E02B 7/20* (2006.01)

(52) U.S. Cl.
CPC ..... *E02B 7/20* (2013.01); *E02D 29/0208* (2013.01)

(58) Field of Classification Search
CPC ..... E02D 29/0208; E02B 3/124; E02B 3/108; E02B 7/005; E02B 7/20; E04C 1/395; E01F 8/025
USPC ..... 405/15, 16, 19, 21, 30, 32, 33, 284, 405/302.6, 302.7; 220/485, 486, 489, 493
See application file for complete search history.

(56) References Cited

U.S. PATENT DOCUMENTS

| | | | | |
|---|---|---|---|---|
| 4,394,924 | A | 7/1983 | Zaccheroni | |
| 4,477,206 | A * | 10/1984 | Papetti et al. | 405/172 |
| 4,804,293 | A * | 2/1989 | Varkonyi et al. | 405/15 |
| 5,647,695 | A | 7/1997 | Hilfiker et al. | |
| 7,249,912 | B2 | 7/2007 | Reese | |
| 7,670,082 | B2 | 3/2010 | Olsta et al. | |
| 7,837,414 | B2 | 11/2010 | Heseldon | |
| 2009/0230373 | A1 * | 9/2009 | Helseden | 256/25 |
| 2009/0250675 | A1 | 10/2009 | Cashin et al. | |
| 2010/0024343 | A1 * | 2/2010 | Eggermont | 52/648.1 |
| 2010/0064627 | A1 * | 3/2010 | Heselden | 52/745.09 |
| 2010/0172701 | A1 | 7/2010 | Tucker et al. | |
| 2013/0022404 | A1 | 1/2013 | Stinson | |

* cited by examiner

*Primary Examiner* — Benjamin Fiorello
*Assistant Examiner* — Carib Oquendo
(74) *Attorney, Agent, or Firm* — Garvey, Smith, Nehrbass & North, L.L.C.; Gregory C. Smith; Julia M. FitzPatrick

(57) ABSTRACT

An improved erosion and sediment control gabion multi-cell device, which includes a first end cell having four rigid upright walls, each wall having a plurality of flow openings therethrough; an interior space defined by the four walls, into which a water permeable material such as sand or rock material is placed; a second end cell of similar construction to the first end cell; a center cell engaged to and sharing a sidewall with each of the first and second cells, the center cell having flexible upright wire mesh front and rear walls to allow the multi-cell gabion to flex upward and downward or side to side to accommodate the terrain onto which the gabion is set in place; and a geotextile fabric liner positioned in each cell to help restrict flow of soil through the device.

20 Claims, 4 Drawing Sheets

GABION EROSION AND SEDIMENT CONTROL DEVICE

CROSS-REFERENCE TO RELATED APPLICATIONS

This is a nonprovisional patent application of U.S. Provisional Patent Application Ser. No. 61/689,362, filed 5 Jun. 2012, which is hereby incorporated herein by reference.

Priority of U.S. Provisional Patent Application Ser. No. 61/689,362, filed 5 Jun. 2012, which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to gabion devices. More particularly, the present invention relates to a portable triple box gabion which is utilized in place of straw and hay bales, silt fences, rock check dams, fiber rolls, sand bags or other types of storm water control devices to control erosion and settlement and for filtering run off water.

2. General Background of the Invention

In the field of gabions, construction activities (ground disturbances of one acre or more) in most cases require erosion controls which are part of storm water run off management programs required by state, federal and local governments. Various types of systems and methods have been used to try to contain the soil on the site and keep it from leaving with the run off water. In the current state of the art, a very common method is straw or hay bales having been historically used on construction sites for erosion and settlement control as check dams, inlet protection, outlet protection, and parameter control. Many applications of straw bales for erosion and sediment control are proving ineffective due to the nature of straw bales, inappropriate placement, inadequate installation, or a combination of all of these three factors. In addition, straw bales are maintenance intensive and can be expensive to purchase. Because many applications of straw and hay bales have been ineffective, the Environmental Protection Agency recommends that other Best Management Practices options are carefully considered in erosion control systems.

The following U.S. Patents are incorporated herein by reference:

| PAT. NO. | TITLE | ISSUE DATE |
|---|---|---|
| 4,394,924 | Process For Making Gabions Provided With Inner Partitions | Jul. 26, 1983 |
| 5,647,695 | Soil Filled Wall | Jul. 15, 1997 |
| 7,249,912 | Temporary Platform or Roadway and Method of Assembling Same | Jul. 31, 2007 |
| 7,670,082 | Contaminant-Reactive Gabion and Method of Manufacture and Use | Mar. 2, 2010 |
| 7,837,414 | Gabions | Nov. 23, 2010 |
| 2010/0172701 | Barrier Fortification Enhancement and Building Structural Units | Jul. 8, 2010 |
| 2013/0022404 | Method and System for Creating a Flood Barrier | Jan. 24, 2013 |

BRIEF SUMMARY OF THE INVENTION

The system of the present invention solves the problem in the art in a simple and straightforward manner. What is provided is a gabion which includes interconnected side walls engaged together at space intervals along the lengths of the gabion by a plurality of partition walls. The spaces between each pair of partition walls would define together with the side walls, at least one individual compartment of the gabion. The center compartment would include flexible side walls made of flexible woven wire mesh while the remaining partition and side walls are made of welded wire mesh and other rigged material. There would be further provided a geotextile liner to prevent filled materials from falling through the gabion walls. The triple box gabion can be coupled together to form a modular gabion structure to protect from storm water, flood waters, soil and slope erosion and the like. Filtering material is positioned between the partition members and the side members. The gabion frame work would further include an open bottom and open top. The open top would permit filtering materials to be added to each compartment while the open bottom would permit filtering materials to be dispensed from the gabion when it is elevated above ground level.

Therefore, it is the principal object of the present invention to provide a device and system for improving erosion and sediment control to replace straw/hay bales, silt fences and other types of storm water control devices presently being used.

It is a further object of the present invention to provide a gabion device and a gabion system which would utilize a multi-compartment gabion or the center compartment would include side walls made of flexible woven wire mesh while the remaining partition and side walls of the two end portions are made of welded wire mesh or other rigid material.

It is a further object of the present invention to provide a gabion system having a flexible central portion which would allow the gabion system to be placed at other positions other than a straight line since the center partition allows flexibility in the up and down, and left and right movement of the gabion in a certain space.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
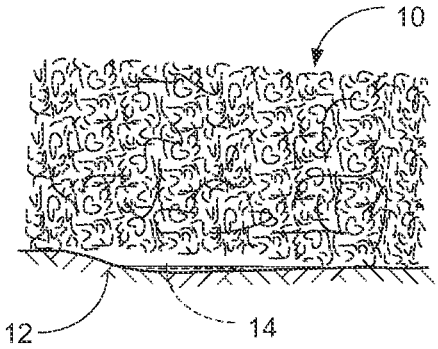
FIG. 1 PRIOR ART
FIG. 1 illustrates a side view of a prior art gabion, in the form of a hay bale.
Figure 7:
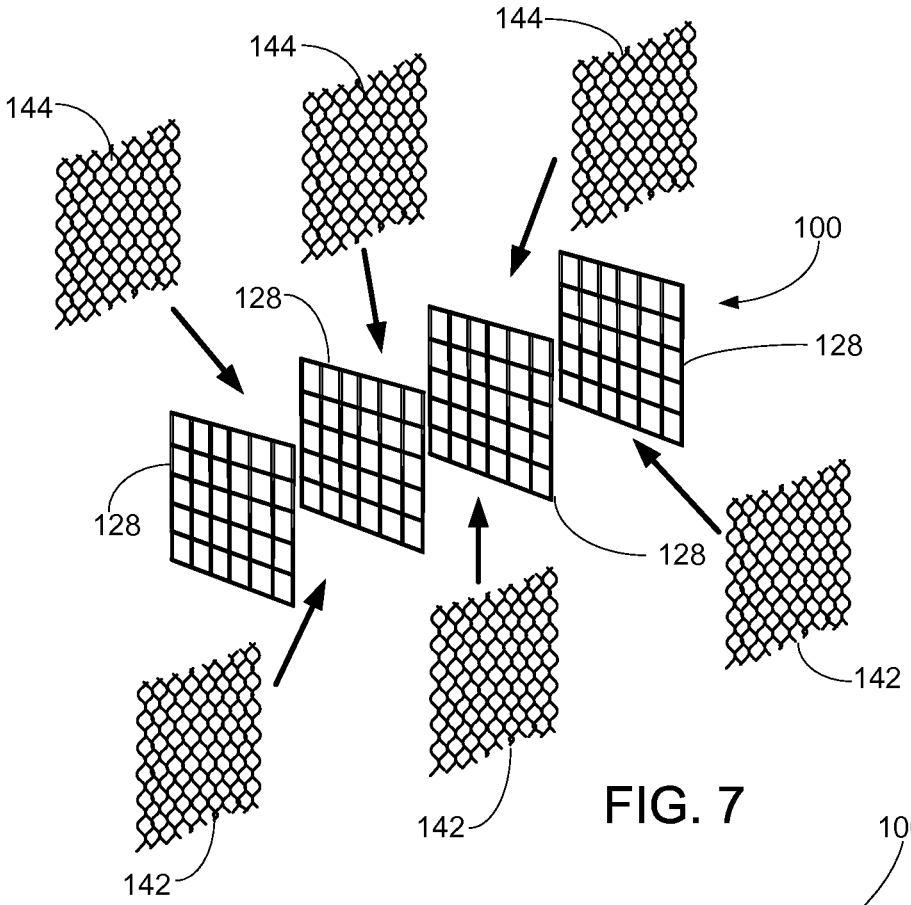
FIG. 7 illustrates an exploded view of a second embodiment of the improved gabion device of the present invention.
Figure 8:
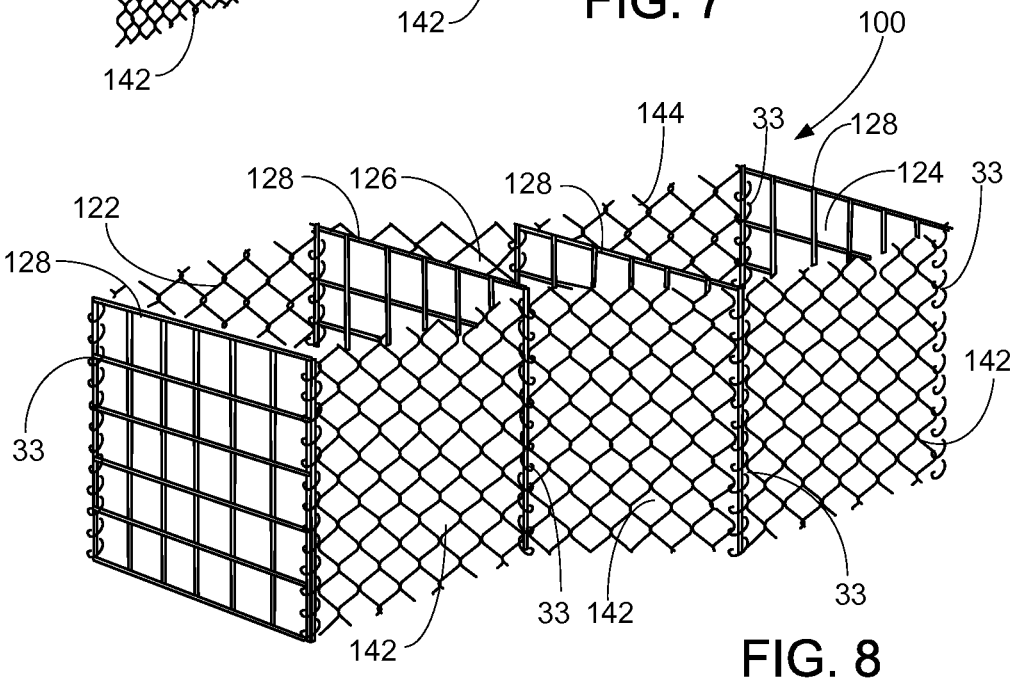
FIG. 8 illustrates an overall view of the second embodiment of the gabion device of the present invention.

FIG. 1 illustrates a view of a prior art gabion in the form of a bale of hay 10, while FIGS. 2-6 and 9 and 10 illustrate the preferred embodiment of the present invention by the numeral 20. FIGS. 7 and 8 illustrate a second embodiment of the improved gabion device as illustrated by the numeral 100.

Before a discussion of the present invention, reference is made to FIG. 1 where there is illustrated a typical prior art gabion device 10, which is a bale of hay 10. As was discussed in the Background of the Invention, the use of multiple bales of hay 10 to serve as gabion devices to control sediment runoff is quite common in the state of the art. Although bales of hay 10 have many problems in their use, such as falling apart during use, another problem is illustrated in FIG. 1. As seen in FIG. 1, a bale of hay 10 has been placed upon a section of uneven terrain 12. Because of the inflexibility of the bale 10, there is a gap 14 between the terrain 12 and the bale 10. Such a gap 14 is very undesirable since water can flow through the gap 14 and carry with it sediment which the gabion device, or hay bale 10 has been set in place to prevent. This is a problem which is being solved by the present invention, as will be discussed.

Figure 2:
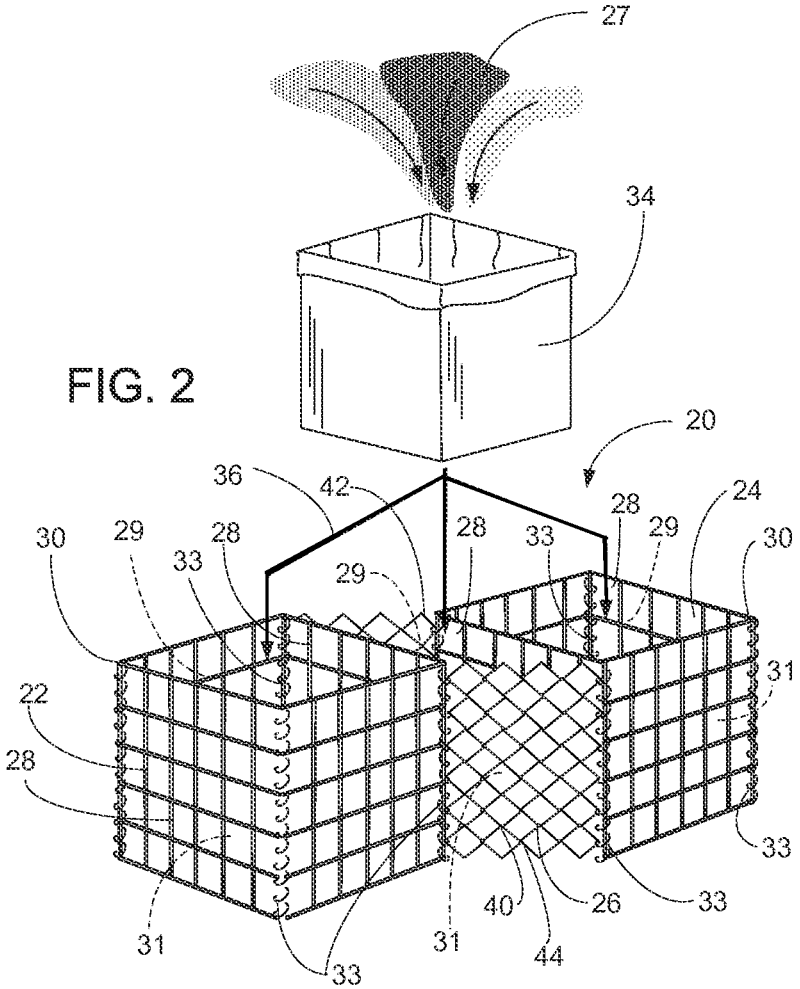
FIG. 2 illustrates an overall exploded view of a multi-cell gabion device of the present invention.
Figure 3:
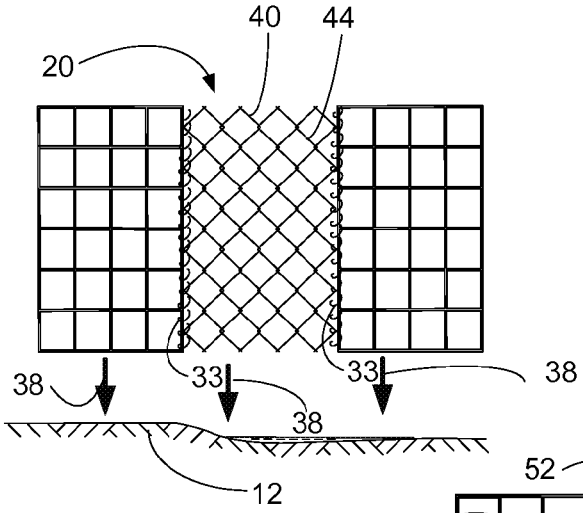
FIG. 3 illustrates the multi-cell gabion device of the present invention being placed onto an uneven surface.

Turning now to the present invention, reference is made to FIGS. 2-6 to discuss the principal embodiment of the present invention by the numeral 20. Turning first to the overall view of the multi-cell gabion 20 as seen in FIG. 2, there is illustrated the multi-cell gabion device 20, which is also referred to as an erosion and sediment controlled device 20, or simply gabion device 20. Gabion device 20 would comprise substantially a three cell box, having a first end cell 22 a second end cell 24 and a third intermediate flexible cell 26. Each of the end cells 22 and 24 comprise a plurality of four rigid wire walls 28 which are engaged to one another at their corners 30, so that each of the end cells 22, 24 define substantially a cubic configured interior 29 into which material can be placed. Each of the cells 22, 24, and 26 would be secured to one another at their corners with preferably a wire coil 33, as illustrated in FIGS. 2 and 3, for example.

As further illustrated, each of the cells 22, 24 and 26 may be configured with a lining of a material such as a geotextile fabric 34, which is illustrated in FIG. 2, as being inserted into each of the cells 22, 24, 26 (Arrows 36) which would be placed into the cells. Following the placement of the geotextile fabric 34, a material is poured into each cell 22, 24 and 26 to act as the erosion control material, such as, for example, stones, gravel, crushed rock, oyster shells, clam shells, sand, dirt, clay phosphorous control material. sand, rocks, or other suitable material, all referred to as material 27. Once material 27 is in place in each of the cells, the walls of each of the three cells (i.e., the two rigid cells 22 and 24 and the intermediate cell 26), are defined by openings 31 which serve as a means for allowing water to flow through the geotextile fabric lining 34, and the material 27 poured into each of the cells, yet prevent material such as sediment or other surrounding dirt or the like from flowing in order to contain the material within a job site.

Figure 4:
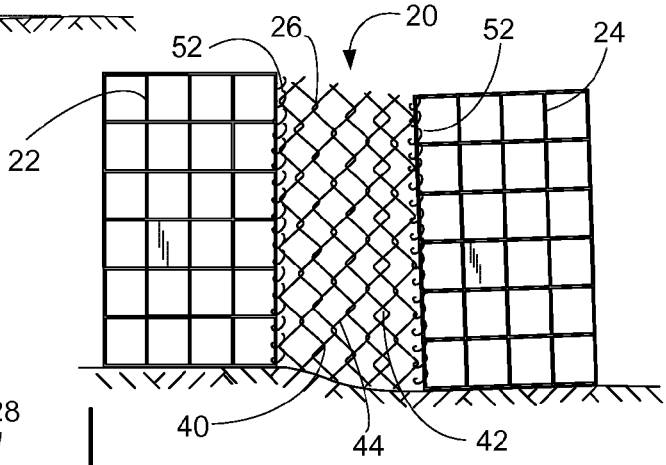
FIG. 4 illustrates the multi-cell gabion device resting on the uneven surface further illustrating the flexibility of the device.

As illustrated in FIGS. 3 and 4, there is illustrated one of the features of the flexible gabion device 20 of the present invention. In FIG. 3, the improved gabion device 20 is being lowered in the direction of arrows 38 onto the uneven terrain 12, the same type of terrain 12 as illustrated in FIG. 1. When the multi-cell gabion 20 is set down, reference is made to FIG. 4 where it is illustrated that the flexible central cell 26, which has a forward wall 40 and rear wall 42 constructed of a flexible mesh material 44, such as wire fencing or the like. The mesh material 44 is able to flex in a manner so that the two rigid end cells 22 and 24 of the device 20 are resting solidly on the terrain 12, while the intermediate or center cell 26 is able to flex and follow the contour of the uneven terrain 12, as seen in FIG. 4. Of course, when these are in place, the geotextile fabric lining 34 would be placed in each of the portions of the gabion device 20, and the material 27, which fill each of the cells 22, 24 and 26, such as sand or rock, would be lowered into each of the cells and then you would have a complete multi-cell gabion 20 which would serve as the erosion and sediment control device.

Figure 5:
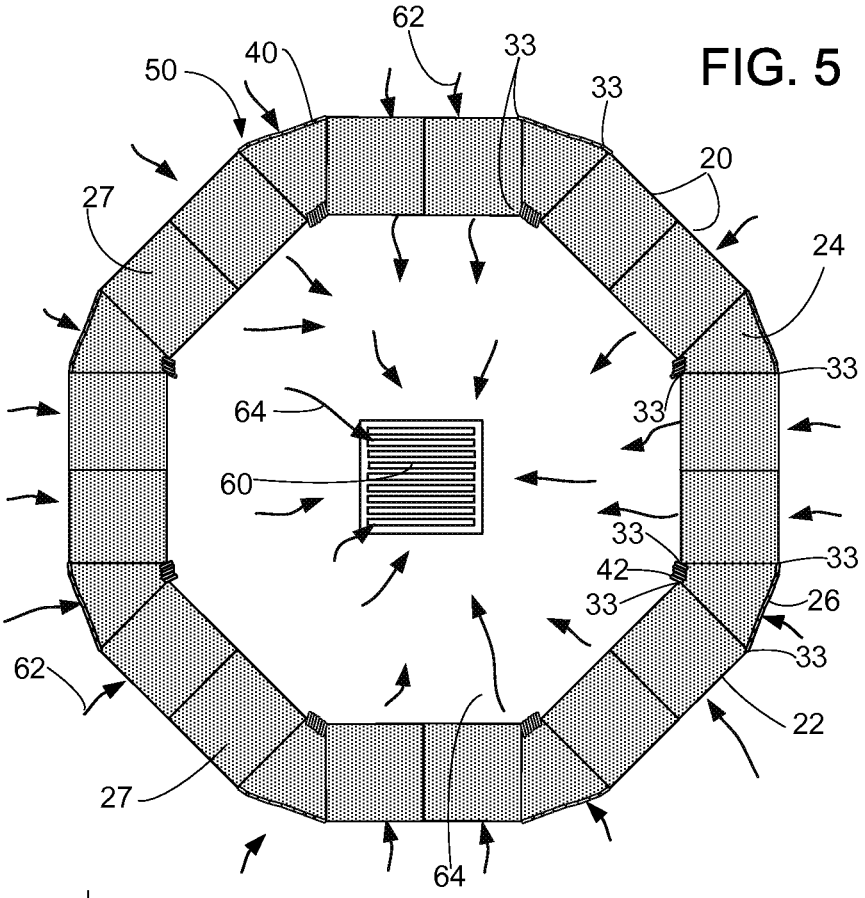
FIG. 5 illustrates a plurality of multi-cell gabion devices interconnected into a total system which has been encircled around a drainage area.

In FIG. 5 there is illustrated a plurality of the multi-cell gabions 20, which are attached to one another end to end by intermeshing the helical coil corner connectors (33) and inserting a metal connecting rod, to define a complete gabion system 50. In the preferred embodiment of the system 50, each end of an individual gabion 20, there would be provided a J shaped steel rod, which would be inserted at each corner of the each of the gabions 20 so as to secure each of the gabions 20 in place. As illustrated, intermediate each of the rigid cells 22 and 24, there is seen the middle cell 26, which in the top view is seen in FIG. 5, because of cell 26 having the flexible mesh front wall 40 and rear wall 42, the result is that the center cell 26 is able to configure substantially into a triangle shaped cell 26, due to the center cell's capability to flex in the manner so as to allow the gabion cells 20 to compress and form a complete circle as they are attached end to end in order to encircle a drain culvert 60, so that water may flow into drain culvert 60, yet sediment is held back by the gabion system 50 surrounding the culvert 60. As seen in FIG. 5, there are illustrated arrows 62 which illustrate water and sediment being rushing into the outer wall of the entire circular gabion system 50, yet a second arrows 64 flowing from the inner wall of the gabion system 50 into the drain culvert 60 which, would represent the flow of water while sediment and the like is being held back from flowing into the drain 60.

Figure 6:
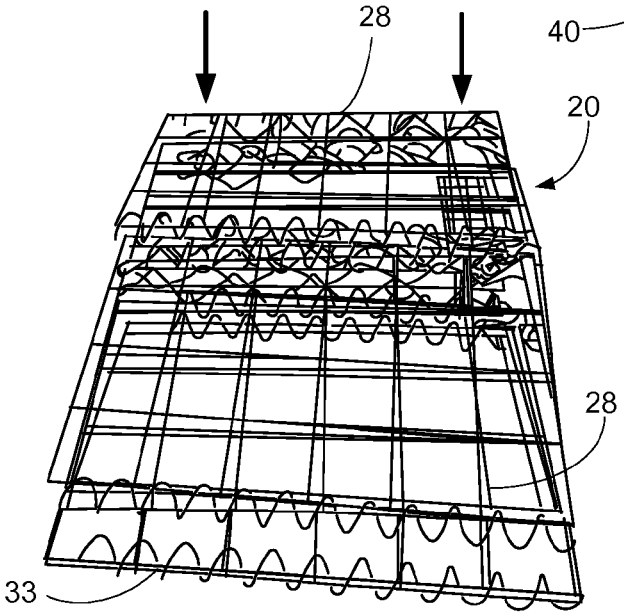
FIG. 6 illustrates a view of the gabion device as it would be stored when not in use.

In FIG. 6 there is illustrated a gabion device 20 as illustrated in FIG. 4 an overall view which when not in use can be collapsed due to the flexibility of the walls engage of the corners into a flat gabion 20, which then could be stacked upon one another in the back of a truck or the like for carrying into the job site.

Figure 9:
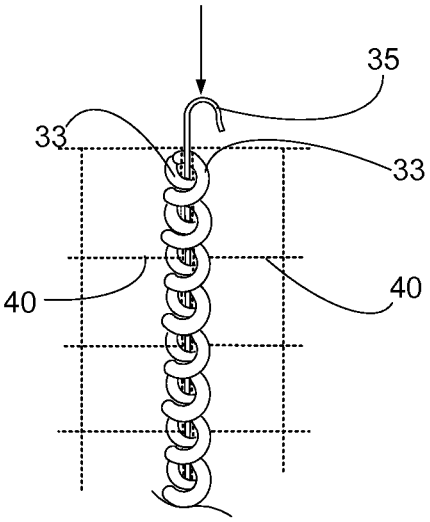
FIGS. 9 and 10 illustrate partial top and side views respectively of the connecting rod interconnecting two adjoining cells of the gabion device of the present invention.
Figure 10:
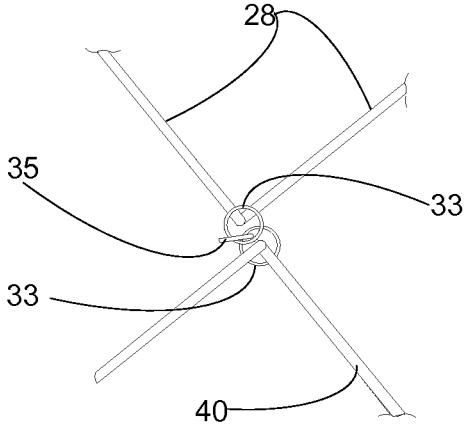

In keeping with the description of the gabion device 20, it should be further noted that the control device 20 would essentially comprise a triple box (3 cell gabion) 20 which would consist of two vertically disposed end cells 22 and 24 that would interconnect with at least two partition flexible front and rear walls 40, 44 extending between the end cells 22 and 24 which would be spaced from each other and from the side members so as to thereby form three separate cells 22, 24 and 26. The sides, ends and partitions contain a plurality of openings which would be large enough to permit the flow of water therethrough. All ends, sides and partitions include openings or perforations 31, which may be slotted or porous. All sides, ends and partitions can be made of expanded metal, heavy wire, plastic, fiberglass or any combination of the same. The two end cells 22, 24 can be joined to the center cell 26 by wire, hinges, helical coil, spring connectors or any other means. For example, as illustrated in FIGS. 9 and 10, the cells 22, 26 have been engaged to one another at their corners 30, with a helical coil 33 placed at each corner 30 intersecting one another. Once in place, a connecting rod 35 has been inserted along the length of the intersecting coils 33 to engage the cells as a unit. Of course, when desired, the rod 35 may be removed and the individual cells are allowed to be separated. Any desired means may be employed to attain the desired rigidity in the box like frame work composed of cells 22 and 24. Each gabion 20 should be a minimum of 12 inches wide, 18 inches high, and 36 inches long with a 12 inch spacing between cell partitions.

The front wall 40 and rear wall 42 may be constructed of woven wire or other flexible material so as to give the gabion 20 flexibility to left, right, up, down to contour over the landscape. Each individual cell or compartment of the gabion is lined with a geotextile material 34. The separate compartments 22, 24, 26 may be filled entirely with loose granular material such as stone, gravel, crushed rock, oyster shells, clam shells, sand, dirt, clay, phosphorous control materials of the like which at a large capacity for removing cell particles without being clogged.

The amount of run off water can be controlled by using different size or amounts of stone, sand, dirt or other controlled material. End cells can be filled with dirt or clay to hold each unit in place while the middle cells can be filled with gravel or stone to allow water to pass through the gabion at a slower pace. If the gabion 20 becomes clogged, it can easily be lifted upward from the material and the framework can be put in a new location and provided with a fresh set of stone or other filler material.

When several gabions, are interconnected to define a gabion system 50, and lined across the path of run off water, they serve to restrict the rate of flow of storm water run off flowing through the gabions as well as an effective filtering barrier. The present invention can also serve as a flow control barrier or spill control bather simply by changing the type of geotextile liner 34 from permeable to impermeable and changing the fill material from stones, gravel, etc. to dirt for flood control or clay absorbent material or other oil absorbent material for spill control.

It can be used as check dams, outlet protection, inlet protection, perimeter control, around catch basins, culverts, curve inlets and any other location where soil erosion and sediment control is needed. The overall system is light enough to be transported in remote areas after forest fires and can be used as check dams to control storm water run off.

Turning now to FIGS. 7 and 8, these are illustrated exploded and overall views respectively of a second embodiment of a multi-cell gabion device of the present invention. As a second embodiment gabion device, it would be enumerated as device 100. The device would be the same configuration as the gabion device 20 as seen in FIGS. 2-6, with the exception that all of the sidewalls 128 of the device 100 would be rigid material, as with the device 20, which would be inflexible, while all of front walls 142 and rear walls 144 of the device 100 would be constructed of mesh material, as with device 20, so that instead of each of the end units 122 and 124 being rigid, and flexible center cell 126, as seen in device 20, all of the cells of device 100 would have the capability to flex in their front walls 142 and rear walls 144. It is foreseen that this particular configuration would achieve even greater flexibility in the device 100, than in device 20, yet would serve the same purpose as the principal embodiment as seen in FIGS. 2-6. It should be kept in mind that except for the new configuration of the front and rear walls 142, 144, all of the features and functions of the second embodiment of the gabion 100 are identical to those of the principal embodiment 20 as discussed referencing FIGS. 2-6, 9 and 10, and therefore, were not repeated, but incorporated by reference to the second embodiment 100.

The following is a list of parts and materials suitable for use in the present invention:

PARTS LIST:

| PART NUMBER | DESCRIPTION |
|---|---|
| 10 | bale of hay |
| 12 | Terrain |
| 14 | Gap |
| 20 | Gabion |
| 22 | First end cell |
| 24 | Second end cell |
| 26 | Flexible cell |
| 27 | Material |
| 28 | Rigid wire walls |
| 29 | Interior |
| 30 | Corners |
| 31 | Openings |
| 33 | Spiral wire |
| 34 | Geotextile fabric |
| 35 | Connecting Rod |
| 36 | Arrows |
| 38 | Arrows |
| 40 | Front wall |
| 42 | Rear wall |
| 44 | Flexible mesh material |
| 50 | Gabion system |
| 60 | Drain culvert |
| 62 | Arrows |
| 64 | Arrows |
| 100 | Gabion device |
| 122 | First end cell |
| 124 | Second end cell |
| 126 | Center cell |
| 128 | Side walls |
| 142 | Front walls |
| 144 | Rear walls |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An improved erosion and sediment control gabion multi-cell device, comprising:

a. a first end cell having four rigid upright walls, each wall having a plurality of flow openings therethrough; and an interior space defined by the four walls, into which a water permeable material is placed;

b. a second end cell having four rigid upright walls, each wall having a plurality of flow openings therethrough, and an interior space defined by the four walls, into which a water permeable material is placed;

c. a flexible center cell engaged to and sharing a sidewall with each of the first and second cells, the center cell having flexible upright wire mesh front and rear walls to allow the multi-cell gabion to flex upward and downward or side to side to accommodate the terrain onto which the gabion is set in place.

2. The device in claim 1, wherein each of the ends cells and center cell are lined with a flow through fabric.

3. The device in claim 1, wherein the water permeable material placed into each of the cells is selected from a group comprising stones, gravel, crushed rock, oyster shells, clam shells, sand, dirt, clay phosphorous control material.

4. The device in claim 1, wherein the flexible front and rear walls of the center cell comprise wire mesh fencing material.

5. The device in claim 1, wherein the openings in the walls of the cells may be perforated, slotted or porous.

6. The device in claim 1, wherein the upright walls of the end cells comprise expanded metal, heavy wire, plastic, fiberglass or a combination of same.

7. An improved erosion and sediment control system, comprising:

a. a multi-cell gabion, each multi-cell gabion further comprising:

i. a first end cell having up to four rigid upright walls, each wall having a plurality of flow openings therethrough, and an interior space defined by the four walls, into which a water permeable material is placed;

ii. a second end cell having up to four rigid upright walls, each wall having a plurality of flow openings therethrough and an interior space defined by the four walls, into which a water permeable material is placed; and iii. a flexible center cell engaged to each of the first and second cells, the center cell having flexible upright front and rear walls to allow the multi-cell gabion to flex upward and downward or side to side to accommodate the terrain onto which the multi-cell gabion is set in place.

8. The system in claim 7, wherein an end of the multi-cell gabion would be secured to at least a second multi-cell gabion to define a continuous gabion system.

9. The multi-cell device in claim 8, wherein other multi-cell gabions would be secured end to end a sufficient distance to provide the erosion and sediment control required at a particular location.

10. The multi-cell gabion in claim 7, wherein the flexible front and rear walls of the center cell allow the gabion system to be placed upon uneven terrain so that no flow spaces are formed between the lower end of the device and the surface upon which the device is placed.

11. The multi-cell gabion in claim 7, wherein the gabion, having no bottom, can be lifted upward from its location if the device becomes clogged or provided with a fresh set of fill material.

12. An improved erosion and sediment control gabion multi-cell device, comprising:

a. a first end cell having four upright walls wherein at least two of the upright walls are rigid, each wall having a plurality of flow openings therethrough, and an interior space defined by the four walls, into which a water permeable material is placed;

b. a second end cell having four upright walls wherein at least two of the upright walls are rigid, each wall having a plurality of flow openings therethrough, and an interior space defined by the four walls, into which a water permeable material is placed; and c. a movable center cell engaged to and sharing a sidewall with each of the first and second cells, the center cell having flexible upright wire mesh front and rear walls to allow the multi-cell gabion to flex upward and downward or side to side to accommodate the terrain onto which the gabion is set in place.

13. The gabion multi-cell device in claim 12, wherein the first and second end cells further comprise flexible upright wire mesh material to provide greater flexibility to the device when it is set in place.

14. The system in claim 12, wherein each of the ends cells and center cell are lined with a geotextile material.

15. The system in claim 12, wherein the water permeable material placed into each of the cells is selected from a group comprising stones, gravel, crushed rock, oyster shells, clam shells, sand, dirt, clay phosphorous control material.

16. The system in claim 12, wherein the flexible front and rear walls of the center cell and end walls of the first and second end cells comprise wire mesh fencing material.

17. The multi-cell device in claim 12, wherein an end of the device would be secured to at least a second multi-cell device with the use of intersecting helical wire at each corner with a connecting rod threaded through the length of the intersecting helical wire.

18. The multi-cell device in claim 12, wherein other multi-cell devices would be secured end to end a sufficient distance to define an erosion and sediment control gabion system required at a particular location.

19. The multi-cell device in claim 18, wherein the flexible walls of the erosion and sediment control gabion system are moved into a triangle form so that the gabion system forms a circle for enclosing a space, wherein water flow is allowed but sediment flow is blocked.

20. The multi-cell device in claim 12, wherein each device is configured to a flat configuration when not in use for storage or transport to a work site.

* * * * *